United States Patent [19]

Dunkle

[11] 4,351,471

[45] Sep. 28, 1982

[54] DUAL CELL LAMINATED CONTAINER

[75] Inventor: George H. Dunkle, Locust, N.C.

[73] Assignee: Weyerhaeuser Company, Tacoma, Wash.

[21] Appl. No.: 228,862

[22] Filed: Jan. 27, 1981

[51] Int. Cl.[3] ..... B65D 5/48

[52] U.S. Cl. ..... 229/15; 229/27; 229/28 R

[58] Field of Search ..... 229/15, 42, 27, 28 R

[56] References Cited

U.S. PATENT DOCUMENTS

| | | | |
|---|---|---|---|
| 2,908,436 | 10/1959 | Miller | 229/15 |
| 3,032,250 | 5/1962 | Miller | 229/42 |
| 3,059,825 | 10/1962 | Thomas | 229/15 |
| 3,066,842 | 12/1962 | Croley . | |
| 3,185,379 | 5/1965 | Kohlhaas . | |
| 3,252,646 | 5/1966 | Rockefeller . | |
| 3,633,794 | 1/1972 | Croley et al. . | |
| 3,701,466 | 10/1972 | Woodrow et al. . | |
| 3,825,174 | 7/1974 | Booth | 229/15 |
| 3,904,105 | 9/1975 | Booth . | |
| 3,958,745 | 5/1976 | Lindsay | 229/15 |
| 4,037,775 | 7/1977 | Bamburg et al. . | |
| 4,046,307 | 9/1977 | Booth et al. . | |
| 4,091,983 | 5/1978 | Booth et al. . | |
| 4,124,158 | 11/1978 | Beck | 229/15 |
| 4,154,387 | 5/1979 | Booth et al. . | |
| 4,186,846 | 2/1980 | Jacalone et al. . | |
| 4,189,086 | 2/1980 | Booth et al. . | |
| 4,219,146 | 8/1980 | Shaggs | 229/15 |

*Primary Examiner*—Herbert F. Ross

[57] ABSTRACT

A cell for a two cell construction in which four slots are provided on the upper and lower edges to align the side walls of the cell in cell construction and to align the cells in container construction. The cells are joined along a first side wall. There are a pair of slots in the first side wall. One of the slots is spaced from the side edge of the first wall a first distance. The slots are spaced from each other a second distance. The third slot is spaced from the first wall side edge the first distance and the fourth slot is spaced from the third slot the second distance. In the lay flat cell the second and third slots are aligned and the first and fourth slots are aligned. A second series of slots are on the bottom edge of the cell. The slots in each cell will be aligned in a container construction.

8 Claims, 7 Drawing Figures

DUAL CELL LAMINATED CONTAINER

BACKGROUND OF THE INVENTION

1. Field of the Invention

A dual cell container.

2. Description of the Art

There are a number of patents describing two cell bulk containers. Exemplary of these are Croley, U.S. Pat. No. 3,066,842 issued Dec. 4, 1962; Kohlhaas, U.S. Pat. No. 3,185,379 issued May 25, 1965; Rockefeller, U.S. Pat. No. 3,252,646 issued May 24, 1966; Croley, U.S. Pat. No. 3,633,794 issued Jan. 11, 1972; Woodrow, et al, U.S. Pat. No. 3,701,466 issued Oct. 31, 1972; Booth, U.S. Pat. No. 3,904,105 issued Sept. 9, 1975; Bamburg, et al, U.S. Pat. No. 4,037,775 issued July 26, 1977; Booth, et al, U.S. Pat. No. 4,046,307 issued Sept. 6, 1977; Booth, et al, U.S. Pat. No. 4,091,983 issued May 30, 1978; Booth, et al, U.S. Pat. No. 4,154,387 issued May 15, 1979; Jacalone, et al, U.S. Pat. No. 4,186,846 issued Feb. 5, 1980; and Booth, et al, U.S. Pat. No. 4,189,086 issued Feb. 19, 1980.

SUMMARY OF THE INVENTION

It should be understood that the containers being considered may hold around a ton of material and consequently are quite large. One of the problems in assembling the containers is to align both the walls of a single cell and the two cells.

It occurred to the inventor that some method had to be found to shorten the time of container assembly necessitated by the problem of aligning both the walls and the cells. He devised a jig and provided slots in the upper and lower edges of the cell which then allowed the cells to be aligned during manufacture. This has greatly reduced the time of assembly of the cells and the containers and has provided a better container construction because the cells are now in alignment.

DESCRIPTION OF THE PREFERRED EMBODIMENT

Figure 1:
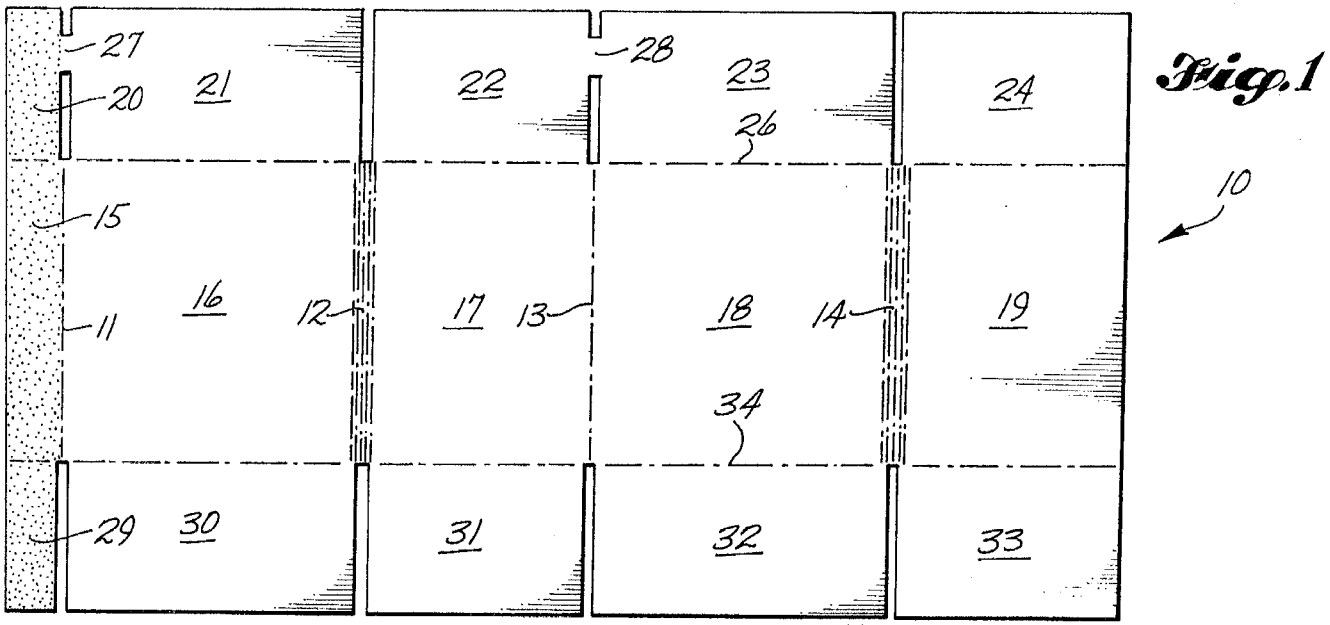
FIG. 1 is a top plan view of the blank for the outer wall of the container.
Figure 2:
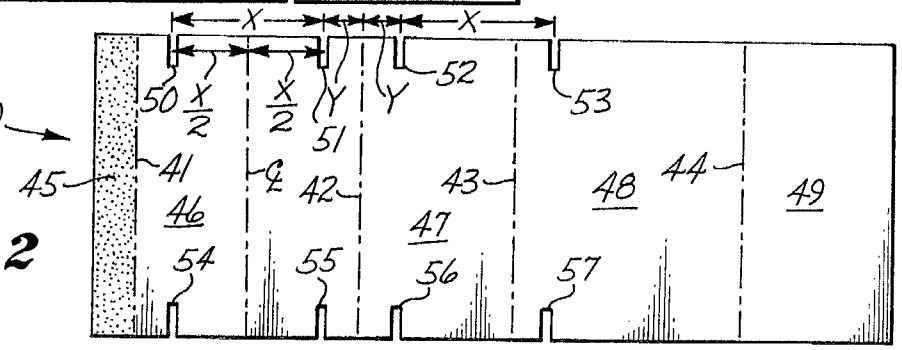
FIG. 2 is a top plan view of the blank for a container cell.
Figure 3:
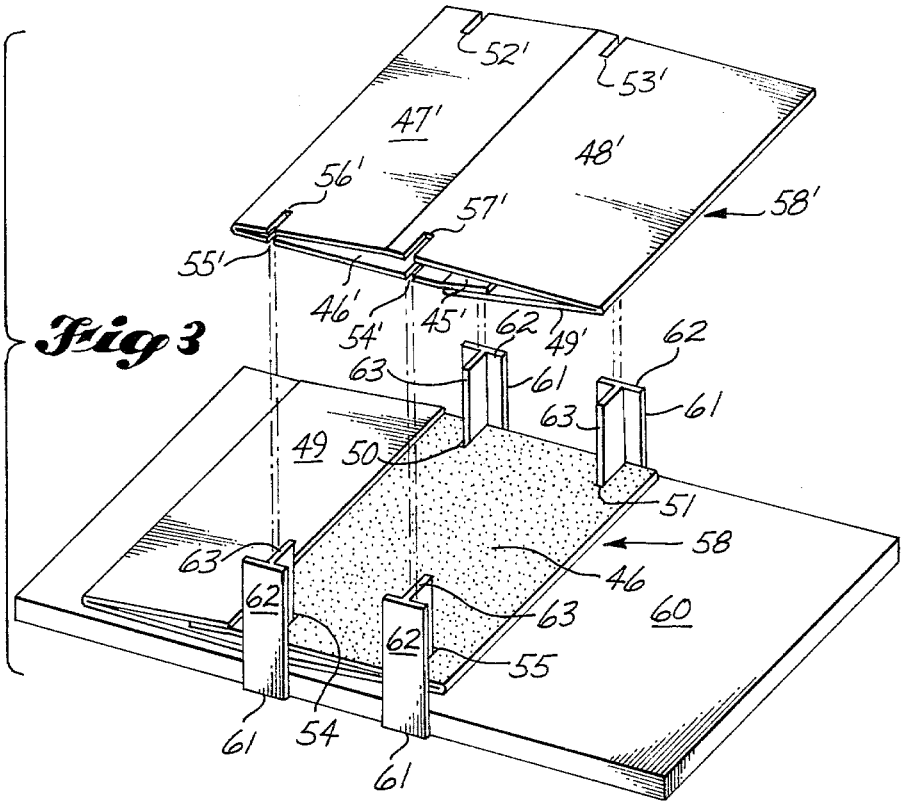
FIG. 3 shows the method of aligning the cells during manufacture.
Figure 4:
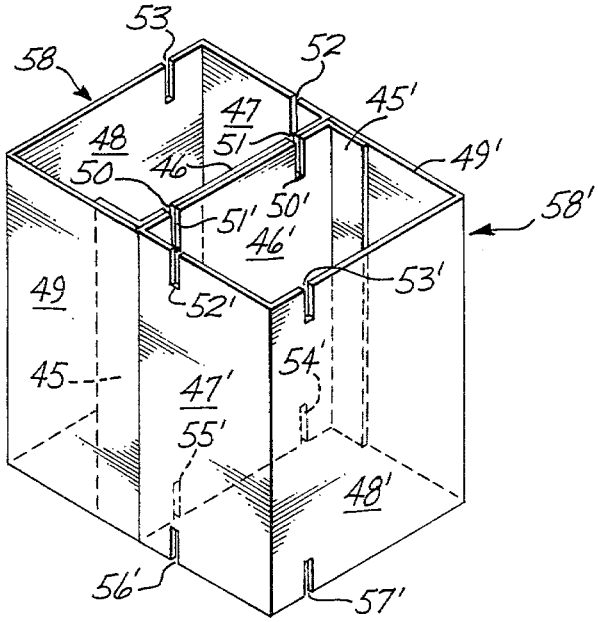
FIG. 4 is an isometric view of the expanded cells after manufacture.
Figure 7:
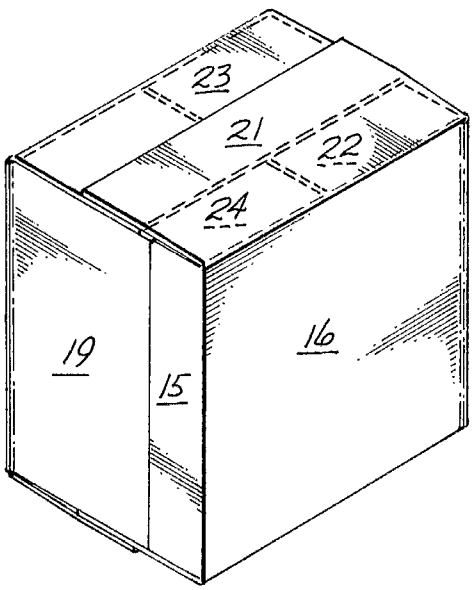
FIG. 7 is an isometric view of the completed and closed container.
Figure 6:
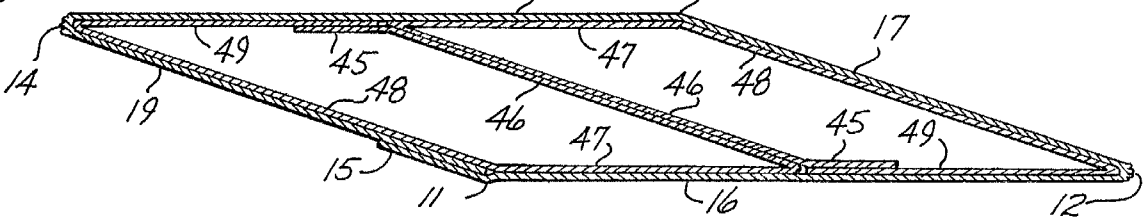
FIG. 6 is a cross-sectional view through the container.
Figure 5:
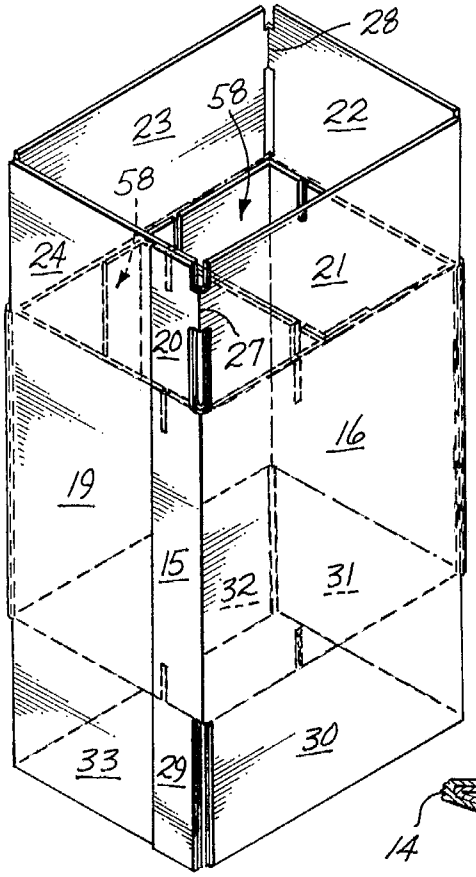
FIG. 5 is an isometric view of the container including both the cells and the container body.

Blank 10 of the outer container body is divided by transverse score lines 11, 12, 13 and 14 into a glue flap 15 and side walls 16, 17, 18 and 19. The score lines 12 and 14 are double score lines to allow the container to be folded into a lay flat condition as is shown in FIG. 6.

Upper glue flap 20 and upper flaps 21, 22, 23 and 24 are hingedly attached to their respective glue flap 15 and side wall 16–19 along upper longitudinal score line 26. Hold down tabs 27 and 28 extend between glue flap 20 and flap 21 and between flaps 22 and 23. In the open container these tabs hold down the upper flaps while the container is being filled. They are then slit so the upper flaps may be placed in position over the top of the container.

Lower glue flap 29 and lower flaps 30, 31, 32 and 33 are attached to glue flap 15 and side walls 16–19 respectively along lower transverse score line 34.

The cell blank 40 is divided by transverse score lines 41, 42, 43 and 44 into a glue flap 45 and a first side wall 46, a second side wall 47, a third side wall 48 and a fourth side wall 49. The upper edge of the blank has a first slot 50, a second slot 51, a third slot 52 and a fourth slot 53. There are four slots, 54, 55, 56 and 57 in the lower wall aligned with the upper slots. Slots 50 and 51 are spaced a distance X from each other. This distance would normally be taken through the center of the slots. Slots 52 and 53 are spaced the identical distance X. The pairs of slots are positioned symmetrically around the vertical score line 42 so that slots 51 and 52 are each spaced from score line 42 a distance Y. Consequently, when the cell 58 is placed in a lay flat condition around score lines 42, slots 51 and 52 will be aligned and slots 50 and 53 will be aligned. The spacing of the lower slots is identical, and in the lay flat cell slots 55 and 56 will be aligned and slots 54 and 57 will be aligned.

This allows the cell to be placed in the jig formed by the plant form 60 and the T bars 61, the upper and lower edges of the cell being guided by the edge guides 62 of the T bars 61 and the slots being guided by the slot guides 63. This would allow the glue flap 45 to be adhered to the side wall 49 in the jig with the side walls in alignment.

In the normal alignment of the cells, the cells are in mirror image with the glue flaps 45 being on opposite sides of the container. If it is desired to have one blank for both cells, then the upper slots 50 and 51 and the lower slots 54 and 55 in the first cell wall should be located symmetrically around the vertical center line of the first wall 46. Consequently, each should be a distance X/2 from the center line C/L of the first wall 46. Then the slot 50 and 53 of cell 58 will be aligned with slots 51' and slot 52' of cell 58' while slots 51 and 52 of cell 58 will be aligned with slots 50' and 53' of cell 58'. There will be similar alignment of the lower slots, slots 54 and 57 of cell 58 lining up with slots 55' and 56' of cell 58' and slots 55 and 56 of cell 58 lining up with slots 54' and 57' of cell 58'.

It is possible to use score lines other than score line 42 as the center line around which the pairs of slots are spaced. For example, score line 41 could also be used for this purpose.

Although four T Bars are shown, only two need to be used. Both would be on the same end of the jig. In the blank and cell, the score lines 41–44 shall be considered to be running in a transverse direction of the blank and the cell, that is, the direction between the cell openings is the transverse direction, and the direction 90° to the transverse direction is the longitudinal direction.

I claim:

1. A rectangular cell for a container said cell having first, second, third and fourth side walls hingedly joined together, a first series of slots in one end edge of said cell comprising a first and a second slot spaced from each other a first distance in said first wall, said second slot being spaced from the adjacent side edge of said first wall a second distance, a third slot on said second wall adjacent said side edge of said first wall and spaced from said first wall adjacent side edge said second distance, and a fourth slot circumferentially spaced from said third slot said first distance and located on the side of said third slot opposite said second slot.

2. The cell of claim 1 in which a second series of slots are spaced transversely from and aligned transversely with said first series of slots.

3. The cell of claim 2 in which said first series of slots are on one end edge of said cell and the second series of said slots are on the other end edge of said cell.

4. A pair of rectangular cells for a container, each cell having first, second, third and fourth side walls hingedly joined together, said cells being joined along their respective first walls, a first series of slots in the same end edge of each of said cells comprising a first and a second slot spaced from each other a first distance in each said first wall, said first and second wall slots in one cell being aligned with said first and second wall slots in the other cell, each said second slot being spaced from the adjacent side edge of said first wall a second distance, a third slot on each said second wall adjacent said side edge of said first wall and spaced from said first wall adjacent side edge said second distance, and a fourth slot circumferentially spaced from said third slot said first distance and located on the side of said third slot opposite said second slot whereby in a lay-flat condition in one cell the second and third slots are aligned and the first and fourth slots are aligned, and in the combined cells the slots of one cell are aligned with the slots of the other cell.

5. The construction of claim 4 in which:

said cells are mirror images whereby the second walls of the cells are on the opposite sides of the construction, and in the lay-flat condition the second and third slots of one cell are aligned with the first and fourth slots of the other cell.

6. The cells of claim 4 in which there are a second series of slots spaced transversely and aligned transversely with said first series of slots.

7. The cells of claim 6 in which said first series of slots are in one end edge of said cells and the second series of slots are in the other end edge of said cells.

8. The pair of cells of claims 4, 5, 6 or 7 further comprising an outer wall around said cells, and upper and lower closure flaps hinged to said outer wall.

* * * * *